US006176261B1

(12) United States Patent
Heusser

(10) Patent No.: US 6,176,261 B1
(45) Date of Patent: Jan. 23, 2001

(54) HYDRAULIC CONTROL DEVICE

(75) Inventor: Martin Heusser, Munich (DE)

(73) Assignee: Heilmeier & Weinlein Fabrik F. Oel-Hydraulik GmbH & Co. KG, Munich (DE)

( * ) Notice: Under 35 U.S.C. 154(b), the term of this patent shall be extended for 0 days.

(21) Appl. No.: 09/329,973

(22) Filed: Jun. 10, 1999

(30) Foreign Application Priority Data

Jun. 17, 1998 (DE) ..... 298 10 860 U

(51) Int. Cl.[7] ..... F15B 13/044
(52) U.S. Cl. ..... 137/596.13; 91/420; 91/451
(58) Field of Search ..... 91/420, 451; 137/596.13

(56) References Cited

U.S. PATENT DOCUMENTS

| | | | | |
|---|---|---|---|---|
| 4,145,958 | | 3/1979 | Ille . | |
| 4,461,314 | * | 7/1984 | Kramer | 91/420 X |
| 4,506,517 | | 3/1985 | Pandzik . | |
| 5,243,761 | | 9/1993 | Sullivan et al. . | |

FOREIGN PATENT DOCUMENTS

| | | |
|---|---|---|
| 3512 696 | 10/1986 | (DE) . |
| 3621 854 | 1/1988 | (DE) . |
| 0 548 513 | 6/1993 | (EP) . |
| 0 681 653 | 11/1995 | (EP) . |
| 0 718 504 | 6/1996 | (EP) . |
| 0 823 559 | 2/1998 | (EP) . |

* cited by examiner

*Primary Examiner*—Gerald A. Michalsky
(74) *Attorney, Agent, or Firm*—Cook, Alex, McFarron, Manzo, Cummings & Mehler, Ltd.

(57) ABSTRACT

In a hydraulic control device for the direction control of at least one highest hydraulic pressure hydro-motor with working pressures above about 400 bar from a pressure source the hydro-motor is connectable via at least one consumer line and two leakage-free black/white directional seated valves selectively with said pressure source or a return line, within in said consumer line a load holding blocking valve is provided in leakage-free seated valve design and where in-between said pressure source and said return line a 2/2 idling or shunting directional seated valve having a hydraulic actuation is provided which in its blocking position is leakage-free from the pressure source towards said return line and in each switching position is leakage-free between said hydraulic actuation and said return line, and wherein said hydraulic actuation of said idling directional seated valve between said load holding blocking valve and one of said directional seated valves is connected with said consumer line.

14 Claims, 4 Drawing Sheets

HYDRAULIC CONTROL DEVICE

Figure 1:
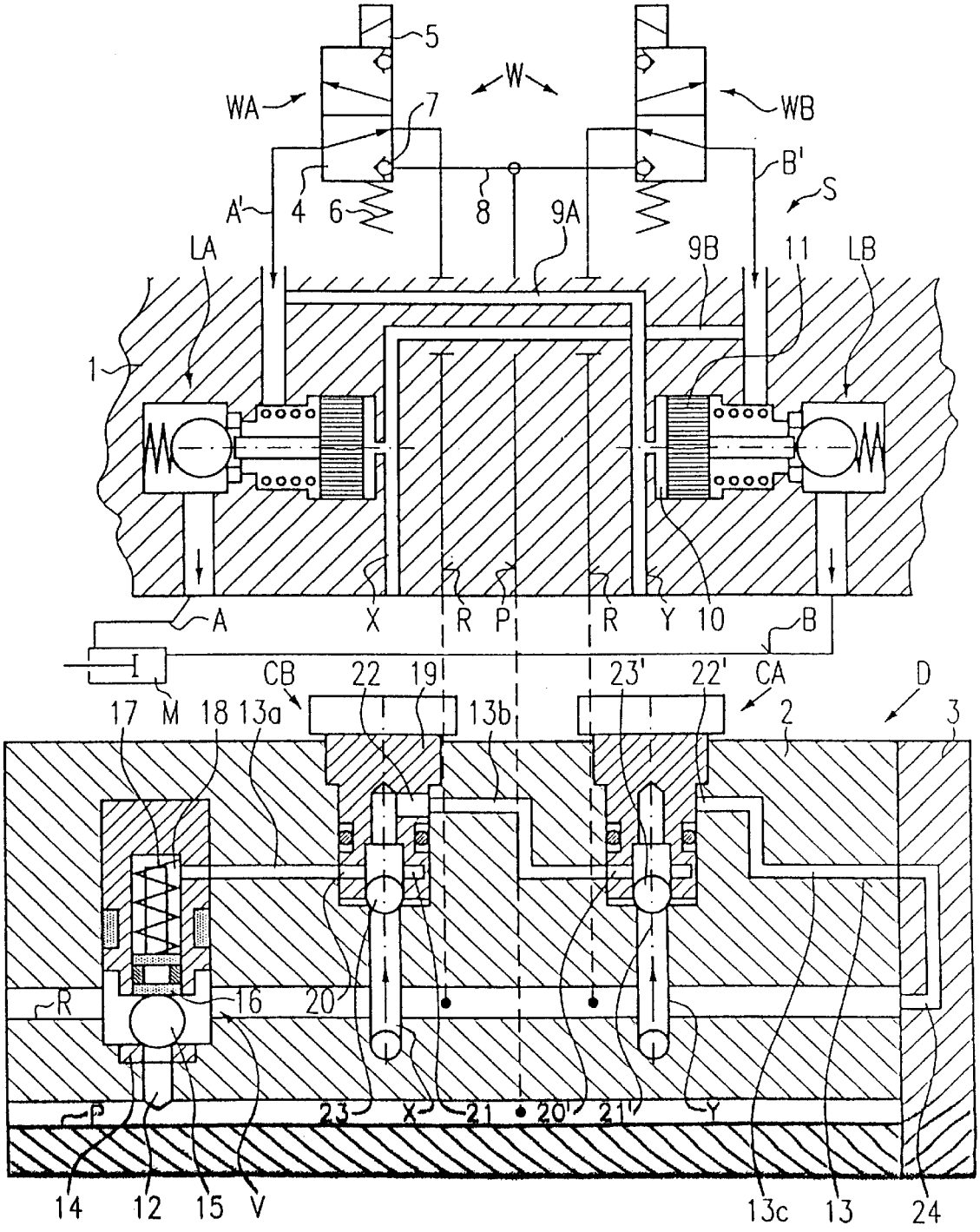

The invention relates to a hydraulic control device.

In hydraulic applications for extreme high pressures (working pressures between about 450 and about 800 bar) different from high pressure hydraulic applications (working pressures up to about 400 bars) frequently only pumps with relatively small delivery volume or multi-stage pumping systems with one pump stage having a small delivery volume of e.g. only 1.0 l/min, are used for achieving said maximum working pressure. This is for example useful in portable devices having an integrated pressure supply system, such as power screwdrivers, riveting devices, building moving devices, etc. In a hydraulic control device for extreme high working pressures however, then a leakage cannot be tolerated as it might be tolerable for high pressure hydraulic application. The reason is that the leakage with increasing pressure progressively is growing leading to the fact that the maximum working pressure cannot be reached or cannot be maintained since said increasing leakage cannot be compensated with such small delivery volumes as mentioned.

In high pressure hydraulic applications (brochure D 7470 B published by Heilmeier und Weinlein, DE, pages 1 and 3) for the directional control of hydro-motors directional seated valves are provided which due to their seated valve design are operating leakage-free. On page 3 of said brochure, example K, for a bi-directional actuable consumer two 3/2 directional seated valves with solenoid actuation are provided between the consumer lines and the pressure and return lines. The consumer lines additionally are supervised by load holding-blocking valves designed with a seated valve function. In hydraulic control devices for high pressure hydraulic application upstream of said solenoid actuated directional seated valves a 2/2 switch valve having a seated valve design is provided between the pressure line or pump line and the return line. Said switching valve is actuated by a solenoid in case that no consumer pressure is needed. Additionally a pressure limiting valve is responding when the maximum system pressure is reached. Another possibility employed in practice uses a pressure sensor connected to the pump line with which pressure sensor an electric switch is coupled to switch on and switch off the pump. As soon as the adjusted pressure is reached, the pump is switched off. Said principle is not useful for hydraulic applications with extremely high working pressures because said principle needs sophisticated control electronic circuitry and leads to extremely high loads for the pressure medium. Furthermore, directional control valves with a piston slide design as widely useful for high pressure hydraulic applications cannot be used for such extreme high working pressures as mentioned, due to the design depending unavoidable leakage and due to potential jamming danger of the piston slides under such extremely high working pressures.

Further prior art is contained in: U.S. Pat. No. 4,145,958, EP-A-0 718 504, U.S. Pat. No. 4,835,966, EP-A-0 823 559, U.S. Pat. Nos. 4,722,359, 4,506,517, 5,290,007, 5,464,330, 5,243,761.

It is a task of the invention to provide a hydraulic control device for the direction control of at least one hydro-motor of hydraulic applications with extremely high working pressures which hydraulic control device should be able to meet the particular requirements of hydraulic applications for extremely high working pressures with simple structural design, which is reliable and which avoids undesirable high loads of the pump or the pumping system.

Said task can be achieved by the features of the invention.

In said hydraulic control device customised for hydraulic applications for extremely high working pressures leakages reliably are avoided since the seated valve design with closure elements and valve seats made for example from hardened steel are absolutely leakage-free in the closure positions. Thanks to the leakage-free operation even extremely high working pressures can be reached with relatively small delivery volumes of the pump and, moreover, can be maintained reliably. Since the load pressure of the hydro-motor is backed up by the load holding blocking valve, in the basic position the system can be pressure relieved upstream of the load holding blocking valve in order to relieve the pump and the pressure medium. Important is that for said pressure relief of the system (idling or shunting condition) no electric signals have to be generated and no hydraulic pressures have to be derived electrically, but that said 2/2-idling-directional seated valve automatically switches into its open position so that the pump then can deliver the pressure medium counter to an extremely low counter-pressure into the return line and does not need to be switched off. In the region between the hydraulic actuation of said directional seated valve and the return line any leakage is avoided with technically simple efforts such that no pressure medium can leak from the pilot line into the return line. Particularly advantageous the pressure signal representing a pressure medium demand and present in the section of the consumer line between said black/white-directional seated valve and the load holding-blocking valve is used which pressure signal practically is available independent from the load pressure. The pressure signal is used to switch said 2/2-shunt directional seated valve leakage-free by means of its hydraulic actuation into the locking position. The idling pressure and the flow resistance in idling condition are extremely low and desirable for the pump. Said pressure signal results from the co-operation between the respective black/white-directional seated valve, the load holding blocking valve associated thereto, and the load pressure maintaining said blocking valve in its locking position. As core of the invention for hydraulic applications with extremely working pressures the leakage freedom of seated valves switching even under said extreme high pressures without jamming danger is combined with the pressure signal resulting from the piping structure in order to achieve an idling or shunting condition which is depending on demand, is reliable, simple in view to control technique and produces no or only negligible losses. A black/white directional seated valve is characterised by fully open and fully closed positions only (black/white) and no intermediate positions where the valve would be only partially open or partially closed.

In a very simple fashion said pressure signal for switching into the idling or shunting-condition is generated by a combination of black/white-directional seated valves and a load holding-blocking valve. Then said pressure signal (a pressure drop) for the switching action into the idling or shunting condition is generated by relieving the system via a second black/white-directional seated valve in the branch from the consumer line towards the return line.

Advantageously for a double-sided actuable hydro-motor alternatively two pressure signals are brought to said hydraulic actuation. Said hydraulic actuation is relieved via said black/white-directional seated valve to the return line for switching the valve into the idling position.

In another embodiment both load holding-blocking valves are hydraulically pilot operated opened by the pressure in the respective other consumer line, and particularly in strict dependency from the directional control pressure in said respective other consumer line. The pilot lines or the pressure signals, respectively, for opening said load holding blocking valves additionally can be used to operate said idling or shunting circuit.

Basically also further hydro-motors can be controlled with the same pressure source and with the help of a common idling or shunting system. By means of the chain of changeover valves the respective highest load pressure is brought into said hydraulic actuation, said hydraulic actuation, however, permanently is leakage free towards the return side.

In another embodiment said black/white directional seated valves are actuated by solenoids. This leads to a quick and sound response behaviour. The seated valve design assures a jam-free switching operation for the extreme high working pressures even with relatively moderate solenoid forces.

Expediently for the maximum and extreme high working pressure a pump or pump stage with low delivery efficiency or volume is used, the working load of which is low, since the system is working leakage-free and with very low idling or shunting counter pressure whenever no pressure demand is detected.

Very simply the idling pressure is determined by a spring the force of which just is sufficient to hold the 2/2-idling-directional seated valve closed in case of a pressureless system.

In a further embodiment the necessary leakage freedom between the hydraulic actuation and the return line is achieved structurally simply. In case of a relatively big actuation surface of the piston a relatively moderate pilot pressure is sufficient and only a small pilot pressure medium volume has to be moved.

In another embodiment the hydraulic actuation does not have to be relieved in the basic position via one of said black/white-directional seated valves towards the return side, since the chain of changeover valves is taking care of said relief thanks to its connection to the return line.

A combination of a control valve with an idling or shunting block is expedient in view to manufacturing and assembly. Said blocks can be combined with further such blocks upon demand in case that a plurality of hydro-motors are to be connected with the same pressure source. The result is a compact control structure.

Alternatively instead of an end plate a further idling or shunting block selectively can be mounted to the one shunting block for a further hydro-motor such that the pilot line circuitry is extended and each further hydro-motor is using the same common 2/2-idling-directional seated valve (modular kit principle).

Advantageously screw-in valve cartridges are provided which can be manufactured with fair costs, can be replaced easily and are reliable and contribute to the compactness of the block structure.

With particular advantages said hydraulic control device is integrated into a portable device containing a pump or pump stage with small delivery rates not only for weight and space reasons but also in view of energy consumption and allowing to reach and maintain said extreme high pressure, while the idling or shunting pressure remains as low as possible.

Figure 2:
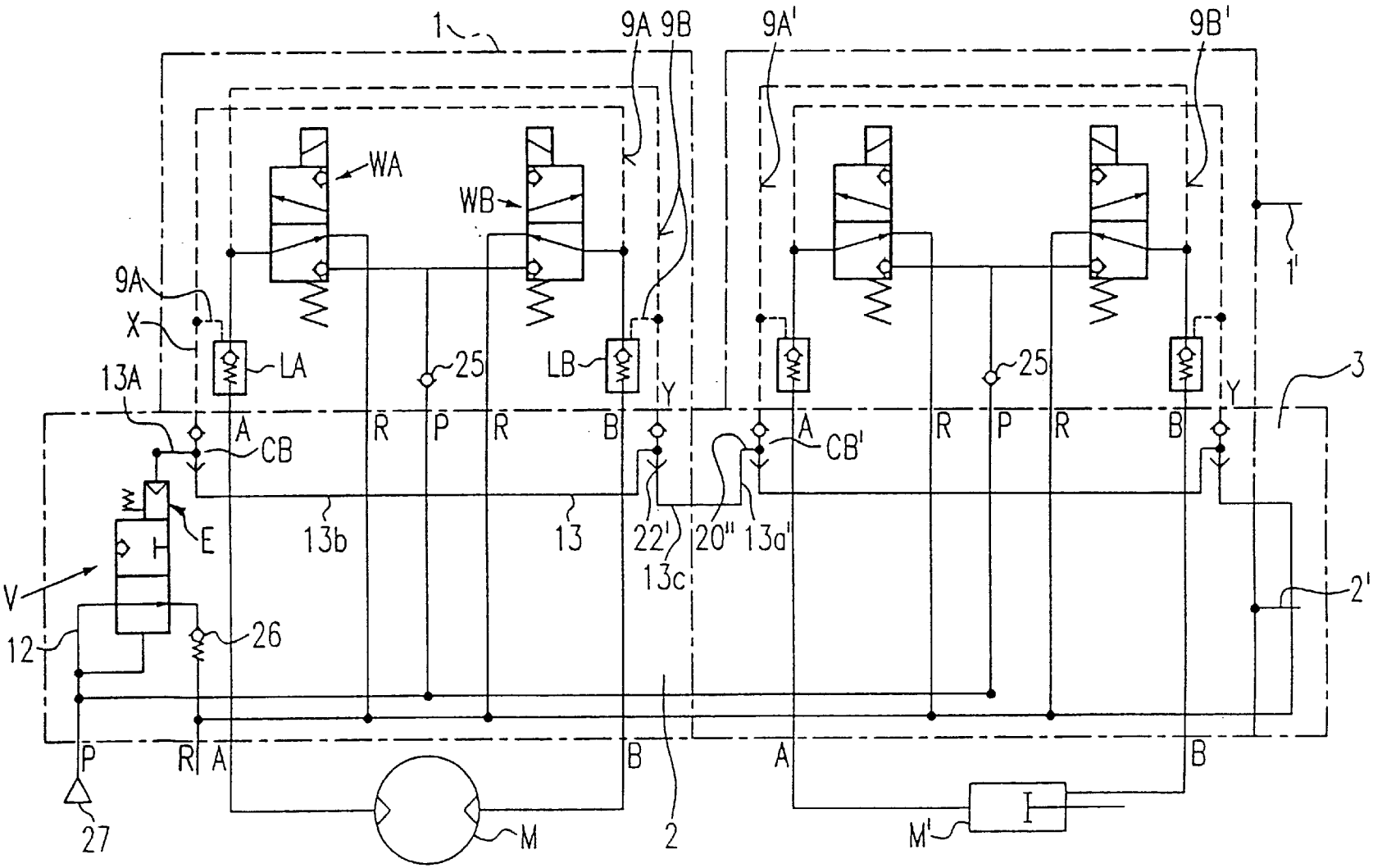
Figure 3:
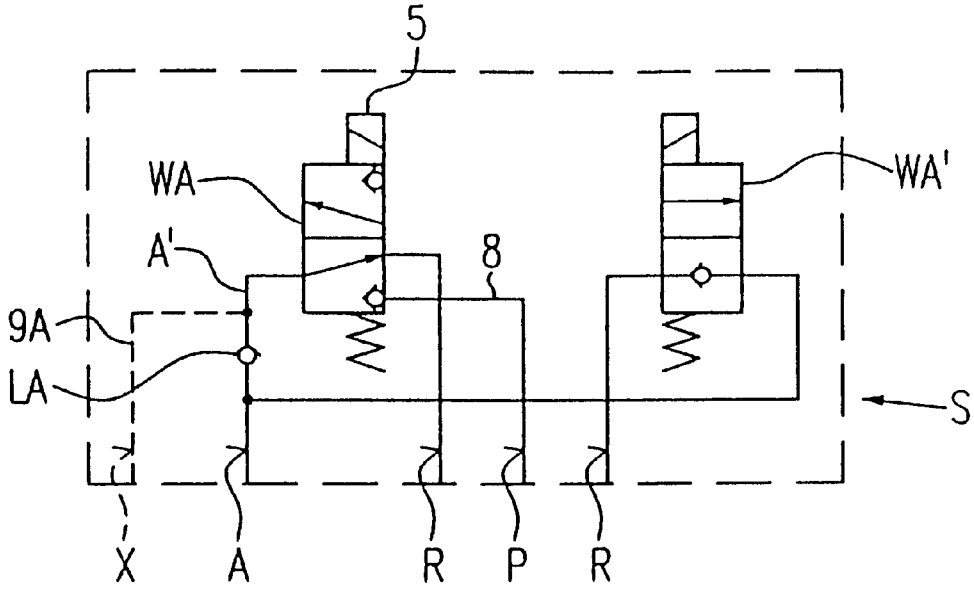
Figure 5:
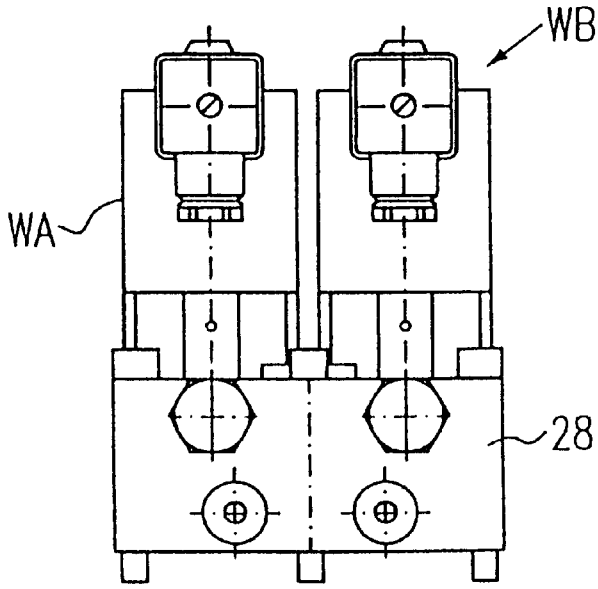
Figure 4:
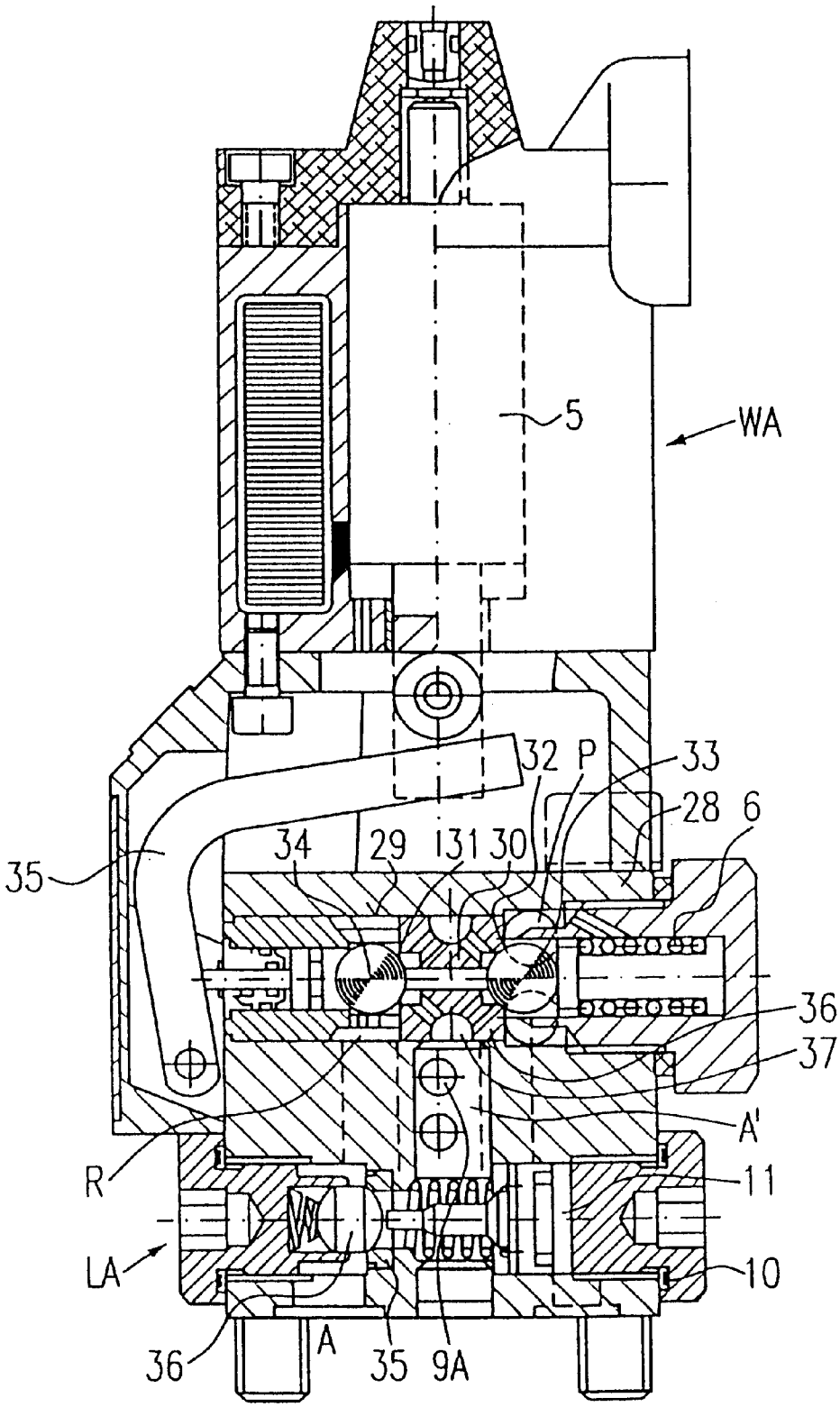

With the help of the drawing embodiments of the invention are described. In the drawing is:

FIG. 1 a hydraulic direction-control device for a double-sided actuable hydro-motor, partially in sections, partially in the form of a block diagram, FIG. 2 a block diagram of a hydraulic direction-control device for more than one hydro-motor, FIG. 3 a block diagram of a direction-control device for a one-sided actuable hydro-motor, FIG. 4 a longitudinal section of a control valve block, and FIG. 5 a side view of the control valve block of FIG. 4.

In FIG. 1 for direction-control of a double-sided actuable hydro-motor M for extreme high working pressures a control valve block 1 and an idling or shunting block 2 are provided, which are shown separated but could be mounted to each other or could even be integrated into a common housing block.

In control valve block 1 to which hydro-motor M is connected via two consumer lines A, B, two 3/2-black/white-directional seated valves WA, WB constitute a directional control valve W for said hydro-motor M. Each directional seated valve is designed as a seated valve having a leakage-free blocking position indicated at 7. Each valve is actuated by means of a solenoid 5 counter to the force of a spring 6. Each consumer line A, B, contains a hydraulically openable load holding-blocking valve LA, LB. Both directional seated valves WA, WB are connected via a common line 8 within idling block 2 with a pump line P and return line R. In the basic position of the device consumer lines A, B are blocked within said load holding blocking valves LA, LB, while simultaneously upstream of said load holding blocking valves a connection is open to return line R. Line 8 is blocked leakage-free at 7. In case that directional seated valve WA is actuated by its solenoid 5, line 8 is connected to consumer line A, so that load holding blocking valve LA automatically opens towards hydro-motor M. During a displacement of hydro-motor M displaced pressure medium flows via consumer line B, load holding blocking valve LB as opened by means of the pressure in consumer line A, and the not actuated directional seated valve WB into return line R.

A pilot line 9A; 9B is connected to a section A', B' of each consumer line A, B, situated between the respective load holding-blocking valve LA, LB and the respective directional seated valve WA, WB. Each pilot line 9A, 9B is connected with a pressure chamber 10 of an opening piston 11 of one of said load holding blocking valves LA, LB, and furthermore, is continued as pilot line X, Y into said idling block 2.

Idling block 2 contains a pump line section P and a return line section R and in a connection 12 in-between P and R a 2/2-idling or shunting directional seated valve V having a hydraulic actuation E. Said valve V contains a valve seat 14 and at the return flow side a closure member 15, preferably a ball. Said closure member 15 is actuated within said return line section R by means of a piston 16 which is displaceable without leakage within a chamber 18. Said piston 16 is biased by a weak spring 17 and by the respective higher load pressure within one of pilot lines 9A, 98, X, Y in closing direction of said closure member 15. The respective higher load pressure is transmitted via at least one changeover valve CB, CA provided within idling block 2. Expediently as well valve V and said changeover valves CB, CA are screw-in valve cartridges.

Within a channel 13 connected via and end plate 3 and short cut channel 24 with said return line section R, said two changeover valves CB, CA are provided in series. Channel 13 leads into chamber 18. In case that another possibility was provided for relieving said chamber 18 or the pressure chambers 10 of said load holding blocking valves towards the return line, respectively, only one changeover valve CB would be sufficient in order to input the respective higher load pressure from one of the consumer lines into chamber 18.

Changeover valve CB has a valve body 19 with a centre port 20 and two side ports 21 and 22. Alternatively one side port 21 or 22 is connected with said centre port 20 by means of a closure member 23 and two valve seats. The second changeover valve CA is of similar design and has a centre port 20' and two side ports 21', 22' as well as a closure member 23'. Pilot line X is connected with side port 21 of changeover valve CB. A section 13*a* of channel 13 connects chamber 18 with centre port 20. Side port 22 is connected by means of a channel section 13*b* with centre port 20' of the next changeover valve CA, the side port 21' of which is connected to pilot line Y, while its other side port 22' is connected via a channel section 13*c* to short cut channel 24.

If none of said black/white-directional seated valves WA, WB is actuated return line pressure is prevailing in chamber 18. Piston 16 then only is loaded by the return pressure and spring 17. The pressure present in pump line P is lifting closure member 15 from valve seat 12 so that the pressure medium from the pump line P flows under low flow resistance directly into return line R.

Upon actuation of directional seated valve WA in consumer line A the pressure increases between the directional seated valve WA and load holding blocking valve LA, which pressure via pilot line 9*a*, Y is displacing closure member 23' upwardly and reaching chamber 18 via channel sections 13*b*, 13*a*. Since the actuation area of piston 16 advantageously is larger than the cross-sectional area of valve seat 14 the seated valve 14, 15 is switched into its blocking position so that the entire pump line pressure or the entire delivery volume, respectively, is brought into consumer line A, opens load holding-blocking valve LA and actuates hydro-motor M. The pressure in pilot line 9A actuates opening piston 11 in chamber 10. Opening piston 11 then will open load holding blocking valve LB in consumer line B so that pressure medium from hydro-motor M is brought through the not actuated directional seated valve WB into return line R. If directional seated valve WA again is switched back into its basic position, the condition as shown in FIG. 1 again is adjusted.

Upon actuation of directional seated valve WB pressure is built up in consumer line B which pressure displaces closure member 23 of changeover valve CB upwardly via pilot line 9B, X and becomes active via channel section 13*a* within chamber 18, in order to bring the idling or shunting directional seated valve V into its leakage-free blocking position. During a displacement of the hydro-motor in the counter-direction the load holding blocking valve LA is opened in order to displace pressure medium. Maximum working pressures up to about 800 bar can be reached and maintained.

In the hydraulic control device S as shown in FIG. 2 at least two hydro-motors M, M' are unified with a pair of black/white directional seated valve WA, WB within two control valve blocks 1, 1' with two idling blocks 2, 2'. Here idling block 2' is flanged against the end surface of idling block 2 instead of end plate 3 as shown in FIG. 1, such that the channel section 13*c* is connected to a channel section 13*a'* of a changeover valve CB' at its centre port 20". Idling directional seated valve V is common for all hydro-motors M, M' and is switched by the respective highest load pressure in one of the consumer lines into its leakage-free blocking position. FIG. 2 additionally is indicating that in each pump line section P extending to one of said hydro-motors a check valve 25 is provided apt to block in backflow direction to the pressure source. Close to idling directional seated valve V a check valve 26 can be provided blocking in flow direction from the return line R to pump line P. A pump 27 supplying pump line P is connected upstream of directional seated valve V to pump line P. The function is as already described for FIG. 1.

In the hydraulic control device S for hydraulic applications for extreme high working pressures and as shown in FIG. 3 the directional control of a one-side actuable hydro-motor (not shown) is carried out by means of a single consumer line A. A 3/2-black/white-directional seated valve WA and 2/2-black/white directional seated valve WA' are provided, each operating with a leakage-free blocking position. The load holding blocking valve LA is a simple check valve with a seated valve design situated in consumer line A between a branching point of a branch line and said 3/2-black/white directional seated valve WA. Said branch line extends via said 2/2-black/white directional seated valve WA' to return line R. From section A' of consumer line A situated between said load holding blocking valve LA and said 3/2-black/white directional seated valve WA pilot line 9A is branching off, which in this case directly extends to the not shown hydraulic actuation of the 2/2-idling directional seated valve V. Also in these hydraulic control devices a pressure signal for the proper actuation of said 2/2-idling directional seated valve V into its blocking position or into the idling position, respectively, will take place in pilot line 9A, since upon actuation of directional seated valve WA within section A' the load pressure is active and since upon switching off of solenoid 5 of directional seated valve WA said section A is pressure relieved towards return line R. In order to move said hydro-motor, e.g. under load, in the opposite direction said 2/2-black/white directional seated valve WA' is actuated so that the pressure medium flows out of consumer line A bypassing load holding blocking valve LA towards the return line.

In FIG. 4 the control valve block 1 as shown for example in FIGS. 1 and 2 only schematically is shown in a longitudinal section of a concise design. Within a housing 28 in a housing bore 29 an insert 30 made from hardened steel is provided having valve seats 31, 32 on both sides communicating via connecting channels 36, 37. A closure member 33, 34, e.g. a hardened and ground steel ball, is associated to each valve seat. The pump line P is connected to the chamber on the right-hand side of FIG. 4 containing closure member 33. Closure member 33 is pressed against valve seat 32 by means of spring 6 and the pressure in pump line P (leakage-free blocking position). Simultaneously closure member 34 is lifted from its valve seat 33 by means of spring 6 so that the chamber on the left-hand side of FIG. 4 containing closure member 34 and the return line R connected to said chamber via said connecting channel 36, 37 are connected to section A' of consumer line A from which section A' pilot line 9A is branching off.

In the lower part of housing 28 the load holding blocking valve LA is provided in which a closure member 36 (a hardened, ground steel ball) is co-operating with a valve seat 35 of an insertion also made from hardened steel. Closure member 36 is lifted from valve seat 35 by means of opening piston 11 actuated in chamber 10 counter to the load pressure originating from consumer line A or is lifted by the pump line pressure prevailing in section A'.

In order to actuate the 3/2-black/white directional seated valve WA solenoid 5 is excited lifting closure member 33 by means of a bent lever 35 counter to the force of spring 6 from valve seat 32 and simultaneously is pressing closure member 34 against its associated valve seat 31. Then the communication from the pump line P via the connecting channels 36, 37 is established to section A' and via the lifted closure member 36 also to consumer line A.

The 3/2-black/white directional seated valve WA can be combined with the second 3/2-black/white directional seated valve WB in a common housing 28 (FIG. 5), such that both valves commonly are connected to the pump line and such that the pilot lines 9A, 9B extend to the respective load holding blocking valves LA, LB and then are continued in their sections X, Y to the changeover valves as shown in FIG. 2 (but not shown in FIGS. 4 and 5).

What is claimed is:

1. Hydraulic control device (S) for the direction control of at least one extreme high hydraulic pressure hydro-motor (M, M') with working pressures above about 450 bar from a pressure source (27), characterised in that said hydro-motor (M, M') via at least one consumer line (A, B) and two leakage-free black/white directional seated valves (WA, WB, WA') selectively is connectable with said pressure source (27) or a return line (R), that within said consumer line (A, B) a load holding blocking valve (LA, LB) is provided having a leakage-free seated valve design, that between said pressure source (27) and said return line (R) a 2/2 idling or shunting directional seated valve (V) equipped with a hydraulic actuation (E) is provided which in its blocking position blocks any communication from pressure source (27) to return line (R), and which in each of its switched positions is leakage-free between said hydraulic actuation (E) and said return line (R), and that the hydraulic actuation (E) of said idling directional seated valve (V) is connected between the respective load holding blocking valve (LA, LB) and one of said of black/white directional seated valves (WA, WB) with said consumer line (A, B) via a pilot line (9A, 9B, X, Y).

2. Hydraulic control device as in claim 1, characterised in that for a one-side actuable hydro-motor a 3/2 black/white directional seated valve (WA) is provided between said consumer line (A) and said pressure source (27) or said return line (R), respectively, and a 2/2 black/white directional seated valve (WA') is provided between said consumer line (A) and said return line (R), that said load holding blocking valve (LA) is designed as a check valve and is situated between said 3/2 directional seated valve (WA) and a consumer line branch line extending to said 2/2 black/white directional seated valve (WA'), and that said pilot line (9A) extending to said hydraulic actuation (E) of said 2/2 idling directional seated valve (V) is connected to a section (A') of said consumer line (A) extending between said load holding blocking valve (LA) and said 3/2 black/white directional seated valve (WA).

3. Hydraulic control device as in claim 1, characterised in that for a double-sided actuable hydro-motor (M, M') a 3/2-black/white directional seated valve (WA, WB) is provided between each consumer line (A, B) and the pressure source (27) or the return line (R), respectively, that in each consumer line (A, B) a hydraulically openable load holding blocking valve (LA, LB) is provided, that a pilot line (9A, 9B) extending to said hydraulic actuation (E) of said 2/2 idling directional seated valve (V) is connected to each consumer line (A, B) at its section (A', B') extending between said load holding blocking valve (LA, LB) and said 3/2 black/white directional seated valve (WA, WB), and that both pilot lines (9A, 9B) are interconnected via at least one changeover valve (CA, CB) inputting the respective higher load pressure to said hydraulic actuation (E).

4. Hydraulic control device as in claim 3, characterised in that said openable load holding blocking valves (LA, LB) are openable alternatively via said pilot lines (9A, 9B) by the hydro-motor consumer pressure.

5. Hydraulic control device as in any of the preceeding claims, characterised in that parallel to said hydro-motor (M) at least one further hydro-motor (M') is connected to said pressure source (27) and said return line (R), respectively, and via leakage-free directional seated valves and at least one load holding blocking valve (LA, LB), that said 2/2 idling directional seat valve (V) is commonly associated to all provided hydro-motors (M, M'), and that said pilot lines (9A, 98, 9A', 9B') of said hydro-motors (M, M') are connected to said hydraulic actuation (E) within a serial chain of changeover valves (CA, CB, CA', CB').

6. Hydraulic control device as in claims 1, 2, 3 or 4, characterised in that said 2/2 and said 3/2 black/white directional seated valves (WA, WB) are actuated by solenoids.

7. Hydraulic control device as in claims 1, 2, 3 or 4, characterised in that said pressure source (27) comprises a pump having low delivery efficiency or a multi-stage pump system having a pump stage of low delivery efficiency, e.g. 1.0 l/min, for a maximum working pressure up to about 800 bar.

8. Hydraulic control device as in claim 1, characterised in that said 2/2 idling directional seated valve (V) is actuated in the direction to its blocking position by a weak spring (17) determining the idling pressure.

9. Hydraulic control device as in claim 1, characterised in that said 2/2 idling directional seated valve (V) is provided with a valve seat (14) and a closure member (15), associated to the return side of said valve seat (14) and biased by means of a piston (16) in closing direction, and that said piston (16) is actuated by load pressure as the exit pressure of a changeover valve (CB, CA) and parallel by a spring (17), the actuation surface of said piston (16) at least as large as the cross-sectional area of said valve seat (14).

10. Hydraulic control device as in claim 3, characterised in that at least two changeover valves (CB, CA) in series are associated to said hydraulic actuation (E), each changeover valve having two side ports (21, 22, 21', 22') and a centre port (20, 20') alternatively connectable with one of said side ports, each of said changeover valves being connected at a side port (21, 21') to pilot line (9A, 9B, X, Y) while said centre port (20) of the changeover valve (CB) situated next to said hydraulic actuation (E) is connected to said hydraulic actuation (E), the other side port (22) of said changeover valve (CB) connected to the centre port (20') of the further changeover valve (CA) and the remaining side port (22') of said further changeover valve (CA) connected to the return line (R).

11. Hydraulic control device as in claims 1, 2, 3, 4, 8, 9 or 10, characterised in that said black/white directional seated valves (WA, WB, WA') and said load holding blocking valves (LA, LB) are provided within a control valve block (1, 1'), and that changeover valves (CA, CB) and said 2/2 idling directional seated valve (V) are provided within an idling block (2, 2') containing respective pump line and return line section (P, R), and being connected with said control valve block (1, 1').

12. Hydraulic control device as in claim 11, characterised in that within said idling block (2) a channel section (13*c*) is provided leading from said remaining side port (22') of a further changeover valve (CA) to one side of said block, that at said side of said block an end plate (3) with a short cut channel (24) for connecting the channel (13*c*) with said return line section (R) is provided, and that instead of said end plate (3) a further equal idling block (2') comprising changeover valves (CB', CA') is mountable then connecting channel section (13*c*) with the centre port (20') of the first further changeover valve (CB').

13. Hydraulic control device as in claims 1, 2, 3, 4, 8, 9, or 10, characterised in that said 2/2 idling directional seated valve (V) is designed as screw-in valve cartridge screwed into a idling block (2) from the outer side.

14. Hydraulic control device as in claims 1, 2, 3, 4, 8, 9, or 10, characterised in that said hydraulic control device (S) is included into a transportable apparatus having an integrated pressure supply for a maximum working pressure up to about 800 bar.

* * * * *